US011223157B2

(12) United States Patent
Nakano

(10) Patent No.: US 11,223,157 B2
(45) Date of Patent: Jan. 11, 2022

(54) FITTING CONNECTOR

(71) Applicant: Yazaki Corporation, Tokyo (JP)

(72) Inventor: Katsuya Nakano, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/070,926

(22) Filed: Oct. 15, 2020

(65) Prior Publication Data

US 2021/0119376 A1 Apr. 22, 2021

(30) Foreign Application Priority Data

Oct. 17, 2019 (JP) ..... JP2019-190363

(51) Int. Cl.

| | |
|---|---|
| ***H01R 24/00*** | (2011.01) |
| ***H01R 13/52*** | (2006.01) |
| ***H01R 13/621*** | (2006.01) |
| *H01R 13/6585* | (2011.01) |
| *H01R 13/6598* | (2011.01) |

(52) U.S. Cl.

CPC ..... *H01R 13/5202* (2013.01); *H01R 13/6215* (2013.01); *H01R 13/6585* (2013.01); *H01R 13/6598* (2013.01)

(58) Field of Classification Search

CPC ..... H01R 13/5202; H01R 13/6215; H01R 13/6585; H01R 13/6598

USPC ..... 439/626

See application file for complete search history.

(56) References Cited

U.S. PATENT DOCUMENTS

| | | | | |
|---|---|---|---|---|
| 4,793,457 | A * | 12/1988 | Siewert | F16D 27/112 192/112 |
| 5,396,976 | A * | 3/1995 | Koitabashi | F16D 27/112 192/112 |
| 6,132,244 | A * | 10/2000 | Leeman | H01R 24/50 439/541.5 |
| 6,385,988 | B1 * | 5/2002 | Ito | F04B 27/0873 62/323.4 |
| 8,011,977 | B2 * | 9/2011 | Tsuruta | H01R 13/4365 439/752 |
| 8,662,920 | B2 * | 3/2014 | Ishibashi | H01R 13/6592 439/564 |
| 8,905,790 | B2 * | 12/2014 | Staudigel | H01R 12/00 439/638 |

(Continued)

FOREIGN PATENT DOCUMENTS

JP 2014-29780 A 2/2014

*Primary Examiner* — Abdullah A Riyami
*Assistant Examiner* — Vladimir Imas
(74) *Attorney, Agent, or Firm* — Kenealy Vaidya LLP

(57) ABSTRACT

A first connector includes a first case and a screw member. The first case includes a first fitting part having a tubular shape. The screw member includes a first screw part and is disposed opposite to an outer peripheral surface of the first fitting part at an interval and held rotatably about a screw axis relative to the first case. The screw axis is aligned with a direction in which the first connector and a second connector are inserted and removed relative to the second connector. The second connector includes a second case and a second screw part. The second case includes a second fitting part having a tubular shape. The second screw part is provided in a connector fixation wall to which the second case is fixed and to which the first case is fixed outside of an outer peripheral surface of the second fitting part.

19 Claims, 10 Drawing Sheets

(56) References Cited

U.S. PATENT DOCUMENTS

| | | | | |
|---|---|---|---|---|
| 9,105,998 | B2 * | 8/2015 | Uno | H01R 13/6315 |
| 9,484,647 | B2 * | 11/2016 | Ishikawa | H01R 9/24 |
| 10,153,584 | B2 * | 12/2018 | Iwabe | H01R 13/631 |
| 10,211,570 | B2 * | 2/2019 | Tanaka | H01R 13/62955 |
| 10,637,185 | B2 * | 4/2020 | Mori | H01R 13/621 |
| 11,121,501 | B2 * | 9/2021 | Tanaka | H01R 13/635 |
| 2015/0140851 | A1 | 5/2015 | Wang | |
| 2016/0043491 | A1 * | 2/2016 | Otsuta | H01R 13/04<br>439/692 |

* cited by examiner

FITTING CONNECTOR

CROSS-REFERENCE TO RELATED APPLICATION(S)

The present application claims priority to and incorporates by reference the entire contents of Japanese Patent Application No. 2019-190363 filed in Japan on Oct. 17, 2019.

BACKGROUND OF THE INVENTION

1. Field of the Invention

The present invention relates to a fitting connector.

2. Description of the Related Art

When two connectors are connected by fitting to each other, a conventionally knows fitting connector uses axial force acting between screw parts of the respective connectors as fitting force for connector fitting. Such a fitting connector is disclosed in, for example, Japanese Patent Application Laid-open No. 2014-29780.

In a conventional fitting connector, each screw part is made of a metallic material. Thus, metallic shavings are potentially generated between the screw parts when the screw parts are fastened or loosened. Fitting parts in each of which a terminal clasp is stored are connected by fitting to each other between the connectors. Thus, in the fitting connector, metallic shavings need to be prevented from entering between the fitting parts. In addition, a waterproof member (sealing member such as a packing) is provided between the fitting parts to seal the gap therebetween. Thus, when metallic shavings enter between the fitting parts of the connectors or adhere to the waterproof member at insertion or removal of the connectors or the like, metallic shavings are potentially dragged between a housing and the waterproof member at insertion or removal of the connectors, or metallic shavings potentially remain between the housing and the waterproof member after completion of connector fitting.

SUMMARY OF THE INVENTION

Thus, the present invention is intended to provide a fitting connector that can prevent shavings from entering between fitting parts.

In order to achieve the above mentioned object, a fitting connector according to one aspect of the present invention includes a first connector and a second connector electrically connected with each other at a connector fitting position at which the connectors are fitted to each other, wherein the first connector includes a first terminal clasp, a first case in which the first terminal clasp is stored and that includes a first fitting part having a tubular shape, and a screw member including a first screw part, disposed opposite to an outer peripheral surface of the first fitting part at an interval, and held rotatably about a screw axis relative to the first case, the screw axis being aligned with a direction in which the connectors are inserted and removed relative to the second connector, the second connector includes a second terminal clasp electrically connected with the first terminal clasp, a second case in which the second terminal clasp is stored and that includes a second fitting part having a tubular shape and connected by fitting to the first fitting part in a tube axial direction, and a second screw part provided in a connector fixation wall to which the second case is fixed and to which the first case is fixed outside of an outer peripheral surface of the second fitting part, the second screw part being configured to generate connector fitting force in the tube axial direction between the first fitting part and the second fitting part by using axial force acting between the first screw part of the screw member as a screw target and the second screw part, and one of the second case and the connector fixation wall includes a dustproof wall erected in the tube axial direction from the connector fixation wall side between the outer peripheral surface side of the second fitting part and the second screw part side.

According to another aspect of the present invention, in the fitting connector, it is desirable that the dustproof wall is formed in a partially cylindrical shape having an inner peripheral surface arcing around the second screw part side.

According to still another aspect of the present invention, in the fitting connector, it is desirable that when the second case is provided with the dustproof wall, the second case includes a coupling part that is elastically deformable in the tube axial direction and through which the dustproof wall is coupled with the second fitting part side, and the dustproof wall and the coupling part have a gap to the connector fixation wall in the tube axial direction.

According to still another aspect of the present invention, in the fitting connector, it is desirable that the first case includes a screw holding part that rotatably holds the screw member, and the screw holding part contacts the dustproof wall in the tube axial direction at the connector fitting position.

According to still another aspect of the present invention, in the fitting connector, it is desirable that the screw member is a male screw member in which the first screw part is formed as a male screw part, and the second screw part is a female screw part formed in the connector fixation wall.

According to still another aspect of the present invention, in the fitting connector, it is desirable that the dustproof wall is formed to prevent shavings from reaching the second fitting part side, the shavings being generated is an operation to tighten or looses the first screw part and the second screw part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a fitting connector according to the present invention will be described below in detail with reference to the accompanying drawings. The present embodiment does not limit the present invention.

Embodiment

An embodiment of the fitting connector according to the present invention will be described based on FIGS. 1 to 10.

Reference sign 1 in FIGS. 1 to 8 denotes the fitting connector of the present embodiment. This fitting connector 1 includes a first connector 1A and a second connector 1B electrically connected with each other at a connector fitting position at which the connectors are fitted to each other.

Figure 8:
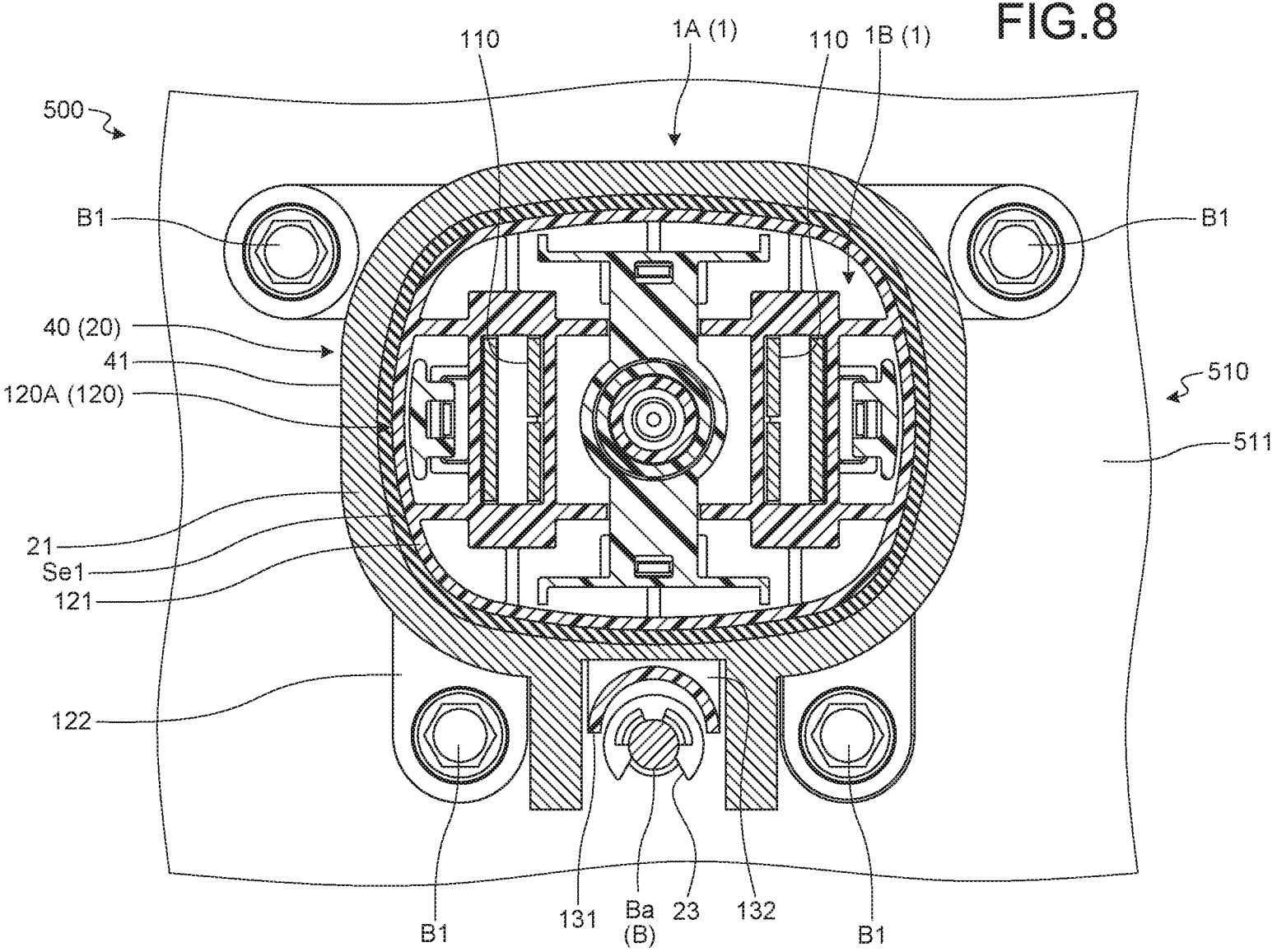
FIG. 8 is a cross-sectional view taken along line Y-Y in FIG. 6.
Figure 9:
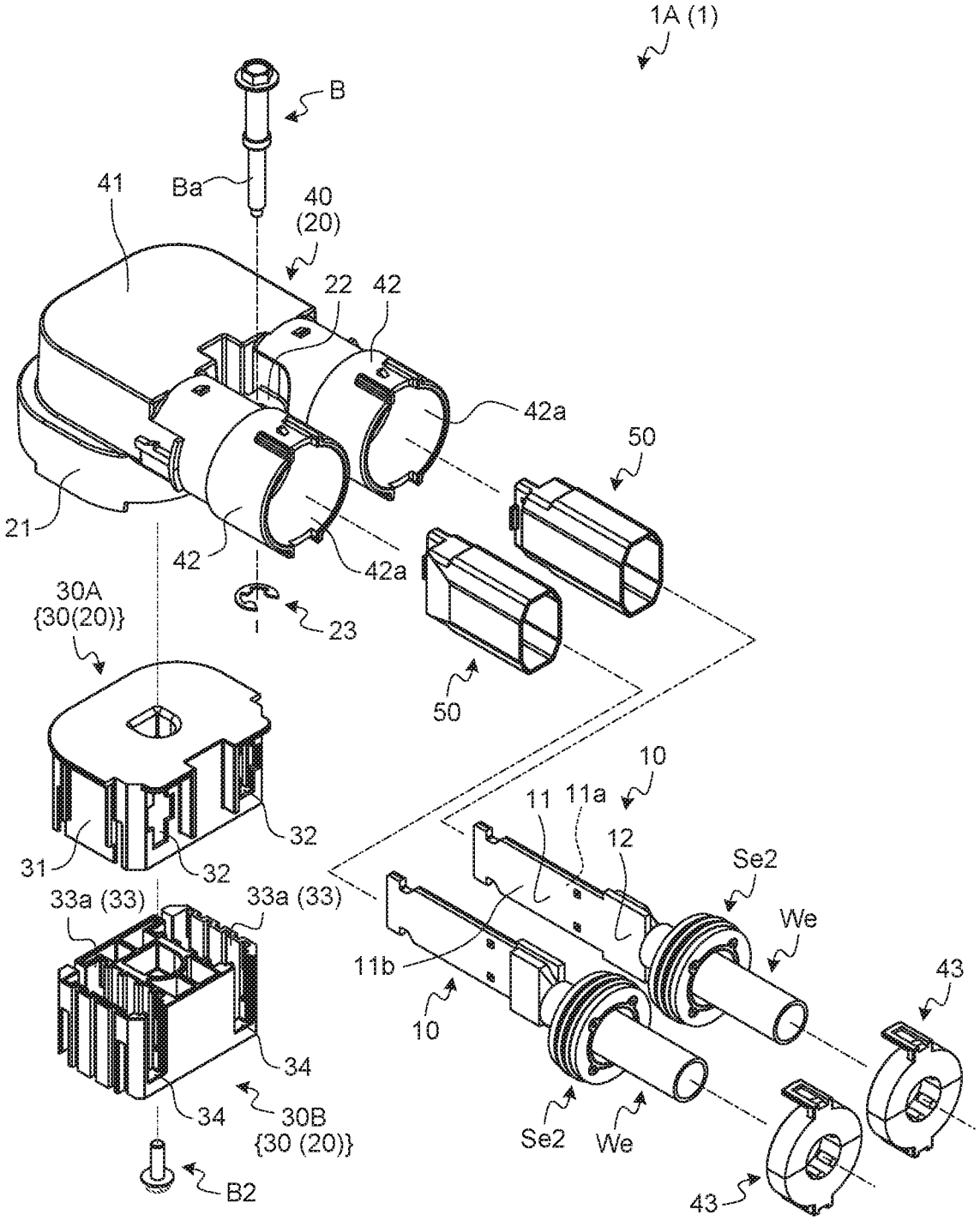
FIG. 9 is an exploded perspective view illustrating a first connector.
Figure 10:
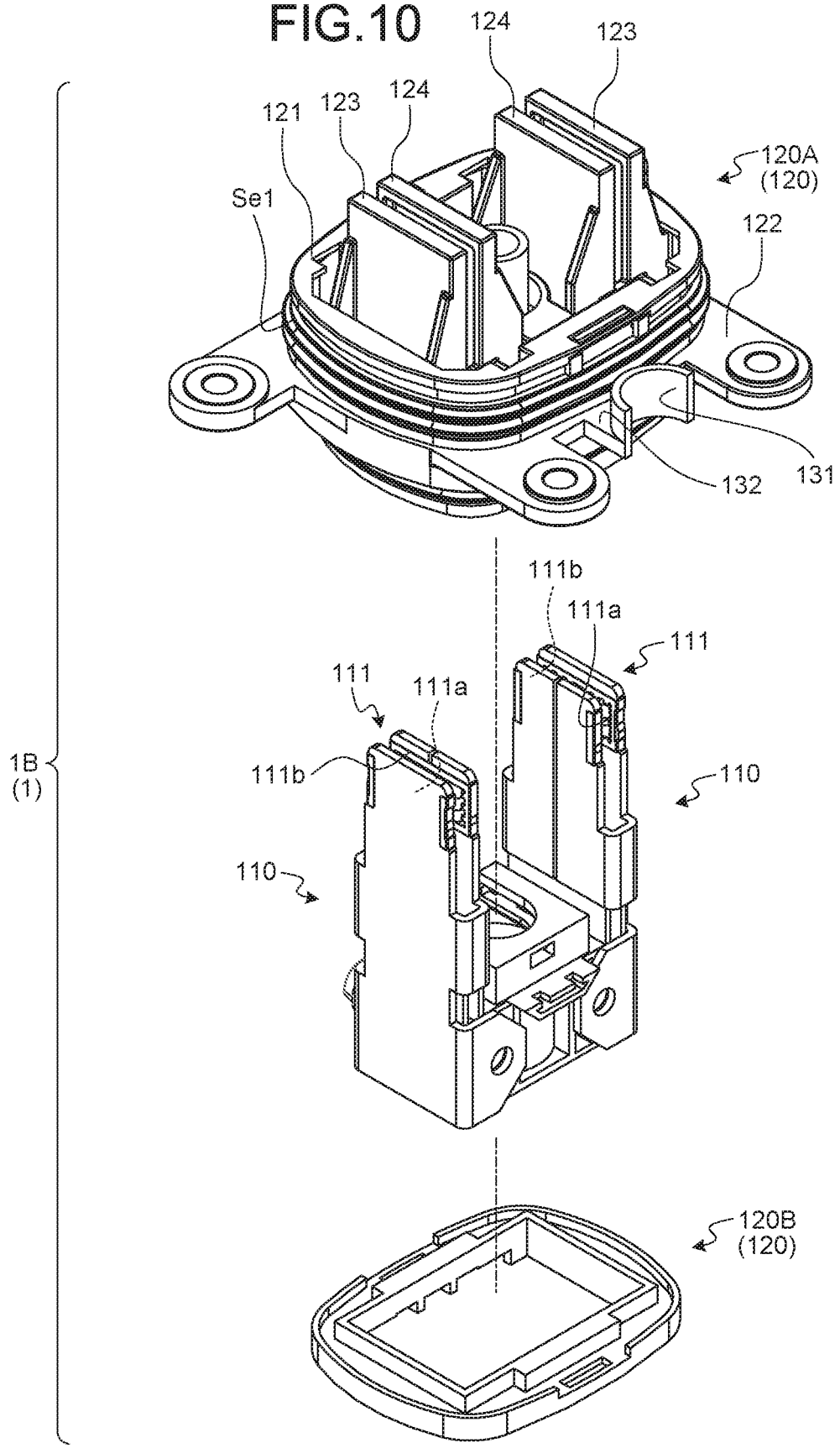
FIG. 10 is an exploded perspective view illustrating a second connector.

The first connector 1A includes a terminal clasp (hereinafter referred to as "first terminal clasp") 10 and a case (hereinafter referred to as "first case") 20 (FIG. 9). The second connector 1B includes a terminal clasp (hereinafter referred to as "second terminal clasp") 110 and a case (hereinafter referred to as "second case") 120 (FIGS. 8 and 10).

For example, when electrically connected with the second connector 1B included in a counterpart instrument 500, the first connector 1A electrically connects the counterpart instrument 500 with an instrument (not illustrated) electrically connected with the first connector 1A through an electrical wire We (FIGS. 1 to 7). The first connector 1A is fixed on the second connector 1B side through the first case 20 at the connector fitting position with the second connector 1B. The first connector 1A fixes the first case 20 to a connector fixation wall 511 on the second connector 1B side by screwing using a screw member B (FIGS. 1 to 7). In this example, part of the outer wall of a case 510 of the counterpart instrument 500 is used as the connector fixation wall 511.

The first connector 1A includes a plurality of first terminal clasps 10. The second connector 1 includes a plurality of second terminal clasps 110 in a number equal to that of the first terminal clasps 10. In this example, two pairs of a first terminal clasp 10 and a second terminal clasp 110 are provided. The first terminal clasps 10 and the second terminal clasps 110 are each formed of a conductive material such as metal. In this example, the first, terminal clasps 10 and the second terminal clasps 110 are each formed of a conductive metal plate as a parent material through press fabrication such as cutting and bending.

Each pair of the first terminal clasp 10 and the second terminal clasp 110 are physically and electrically connected with each other at the connector fitting position. The first terminal clasp 10 includes an electrical connection part 11 physically and electrically connected with the second terminal clasp 110 (FIG. 9). The second terminal clasp 110 includes an electrical connection part 111 physically and electrically connected with the first terminal clasps 10 (FIG. 10). One of the electrical connection parts 11 and 111 is formed a female terminal shape, and the other is formed in a male terminal shape. Each pair of the first terminal clasp 10 and the second terminal clasp 110 are physically and electrically connected with each other at the connector fitting position when the electrical connection parts 11 and 111 are connected by fitting to each other. In this example, the electrical connection part 11 is formed in a male terminal shape, and the electrical connection part 111 is formed in a female terminal shape.

The male electrical connection part 11 is formed in a rectangular plate shape having two flat wall surfaces (a first wall surface 11*a* and a second wall surface 11*b*) (FIG. 9). In the electrical connection part 11, at least one of the first wall surface 11*a* and the second wall surface 11*b* is used as a contact part of physical and electrical connection with the female electrical connection part 111. The female electrical connection part 111 includes two contact parts (a first contact part 11*a* and a second contact part 111*b*) that are disposed opposite to each other at an interval and between which the electrical connection part 11 is fitted (FIG. 10), In each pair of the first terminal clasp 10 and the second terminal clasp 110, the first wall surface 11*a* and the first contact part 111*a* contact each other and the second wall surface 11*b* and the second contact part 111*b* contact each other when the electrical connection part 11 is fitted between the first contact part 111*a* and the second contact part 111*b*. The electrical connection part 11 is fitted to the electrical connection part 111 from one of the four sides of the rectangle in a direction orthogonal to the side and along the plane direction of the first wall surface 11*a* and the second wall surface 11*b*. In this example, the electrical connection part 11 is fitted to the electrical connection part 111 from one of two sides connecting a side provided with an electrical wire connection part 12 to be described later and a side opposite to the side.

The first terminal clasp 10 further includes the electrical wire connection part 12 physically and electrically connected with a terminal of the electrical wire We (FIG. 9). The electrical wire connection part 12 of this example may be bonded by pressing to the terminal of the electrical wire We through crimping or the like or may be fixed to the terminal through welding or the like. In this example, the electrical wire connection part 12 is fixed to the terminal of the electrical wire We by welding or the like. The electrical connection part 11 has two sides in a direction orthogonal to the direction of fitting to the electrical connection part 111. The electrical wire connection part 12 is disposed on one of the two sides of the electrical connection part 11 in the orthogonal direction, and the electrical wire We extends from the electrical wire connection part 12 in the orthogonal direction. In the terminal clasp 10, a side opposite to the side on which the electrical wire connection part 12 is provided is referred to as a leading end.

The first case 20 of the first connector 1A is a storage component in which the first terminal clasp 10 and the terminal of the electrical wire We are stored. The electrical wire We extends out of the first case 20. The second case 120 is a storage component in which the second terminal clasp 110 is stored.

The first case 20 includes a fitting part (hereinafter referred to as "first fitting part") 21 having a tubular shape (FIGS. 1 to 9). The second case 120 includes a fitting part (hereinafter referred to as "second fitting part") 121 having a tubular shape (FIGS. 1, 3, 4, 7, 8, and 10). The first fitting part 21 and the second fitting part 121 are connected by fitting to each other between the first case 20 and the second case 120 in a tube axial direction. The first fitting part 21 and the second fitting part 121 may be formed in a configuration in which the second fitting part 121 is fitted into the inner space of the first fitting part 21, or may be formed in a configuration in which the first fitting part 21 is fitted into the inner space of the second fitting part 121. In any configuration, an annular gap is formed between the inner peripheral surface of the first fitting part 21 and the outer peripheral surface of the second fitting part 121 at the connector fitting position. Thus, a waterproof member Se1 (sealing member such as a packing) having an annular shape is interposed between the surfaces to seal the annular gap (FIGS. 1, 3, 4, 7, 8, and 10).

In this example, the second fitting part 121 is coaxially fitted into the inner space of the first fitting part 21. The waterproof member Se1 is attached to the outer peripheral surface of the second fitting part 121 coaxially with the second fitting part 121. Thus, the inner peripheral surface side of the first fitting part 21 of this example is connected by fitting to the outer peripheral surface side of the second fitting part 121 through the waterproof member Se1.

Specifically, the first case 20 may be achieved by only an insulating housing or may be achieved by an insulating housing and a shield shell made of a metallic material. The first connector 1A of this example is configured as what is called a shield connector capable of preventing entering of external nose. Accordingly, the first case 20 in this example includes an insulating housing 30 and a shield shell 40 made of a metallic material (FIGS. 2, 4, 7, and 9).

The housing 30 is formed of an insulating material such as synthesis resin. The housing 30 stores at least the first terminal clasp 10.

Figure 2:
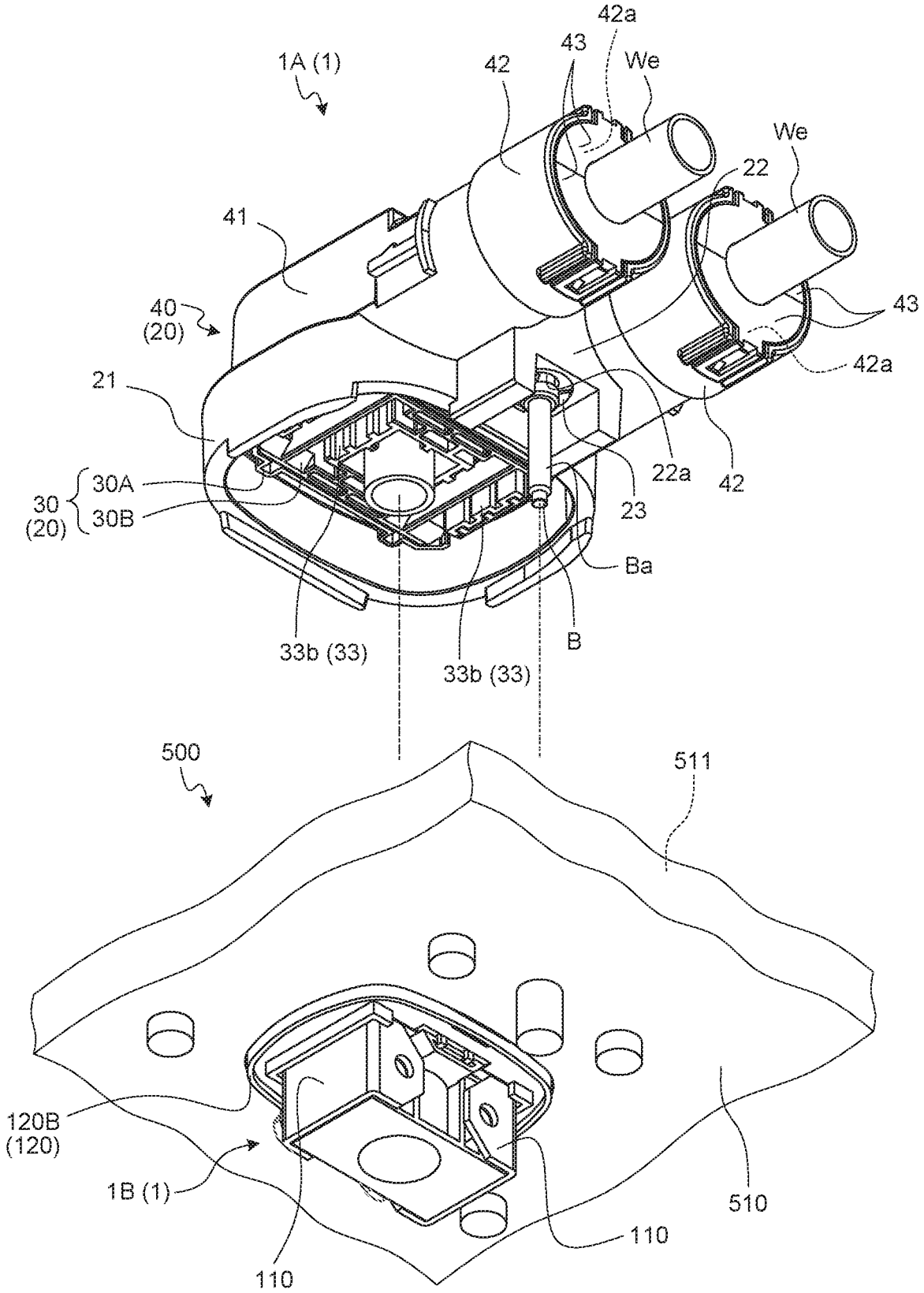
FIG. 2 is an exploded perspective view of the fitting connector of the embodiment before connector fitting when viewed at another angle.

The housing 30 may be configured as one component or may be configured as an assembly of a plurality of components. The housing 30 in this example includes a first storage member 30A and a second storage member 30B (FIGS. 2, 4, and 9).

The first storage member 30A is shaped in a tubular body having at least one end opened in the tube axial direction, and the second storage member 30B is inserted into the inner space through the opening in the tube axial direction. An insertion hole 32 through which the first terminal clasp 10 is inserted into the inner space is formed through an outer peripheral wall 31 of the tubular shape of the first storage member 30A (FIG. 9). The insertion hole 32 is a through-hole into which the first terminal clasp 10 is inserted from a leading end on the electrical connection part 11 side, and is formed for each first terminal clasp 10. Each terminal clasp 10 is inserted into the inner space of the first storage member 30A through the insertion hole 32 in the same orientation. The first storage member 30A of this example stores the electrical connection part 11 in the inner space with the electrical wire connection part 12 protruding out of the insertion hole 32.

The second storage member 30B includes a terminal storage room 33 in which the electrical connection part 11 is stored in the inner space of the first storage member 30A (FIG. 9). The terminal storage room 33 is formed for each terminal clasp 10. As the second storage member 30B is inserted into the inner space of the first storage member 30A, the electrical connection part 11 stored in the inner space of the first storage member 30A becomes stored in the terminal storage room 33 through an opening 33*a*. The storage of the electrical connection part 11 into the terminal storage room 33 is completed when the storage of the second storage member 30B into the inner space of the first storage member 30A is completed. The second storage member 30B, which allows such storage of the electrical connection part 11 into the terminal storage room 33, includes a cutout part 34 that is continuous with the opening 33*a* on the outer peripheral surface side and through which the terminal storage room 33 is communicated with the outside (FIG. 9). The electrical wire connection part 12 protrudes out of the second storage member 30B through the cutout part 34. The cutout part 34 is disposed opposite to the insertion hole 32 so that the electrical wire connection part 12 protrudes out of the insertion hole 32 of the first storage member 30A when the second storage member 30B is stored in the inner space of the first storage member 30A. In the second storage member 30B, the terminal storage room 33 has another opening on a side opposite to the opening 33*a* side, and the other opening is used as a terminal insertion opening 33*b* through which the electrical connection part 111 of the second terminal clasp 110 is stored in the terminal storage room 33 (FIG. 2). The electrical connection part is physically and electrically connected with the electrical connection part 11 in the terminal storage room 33.

Figure 4:
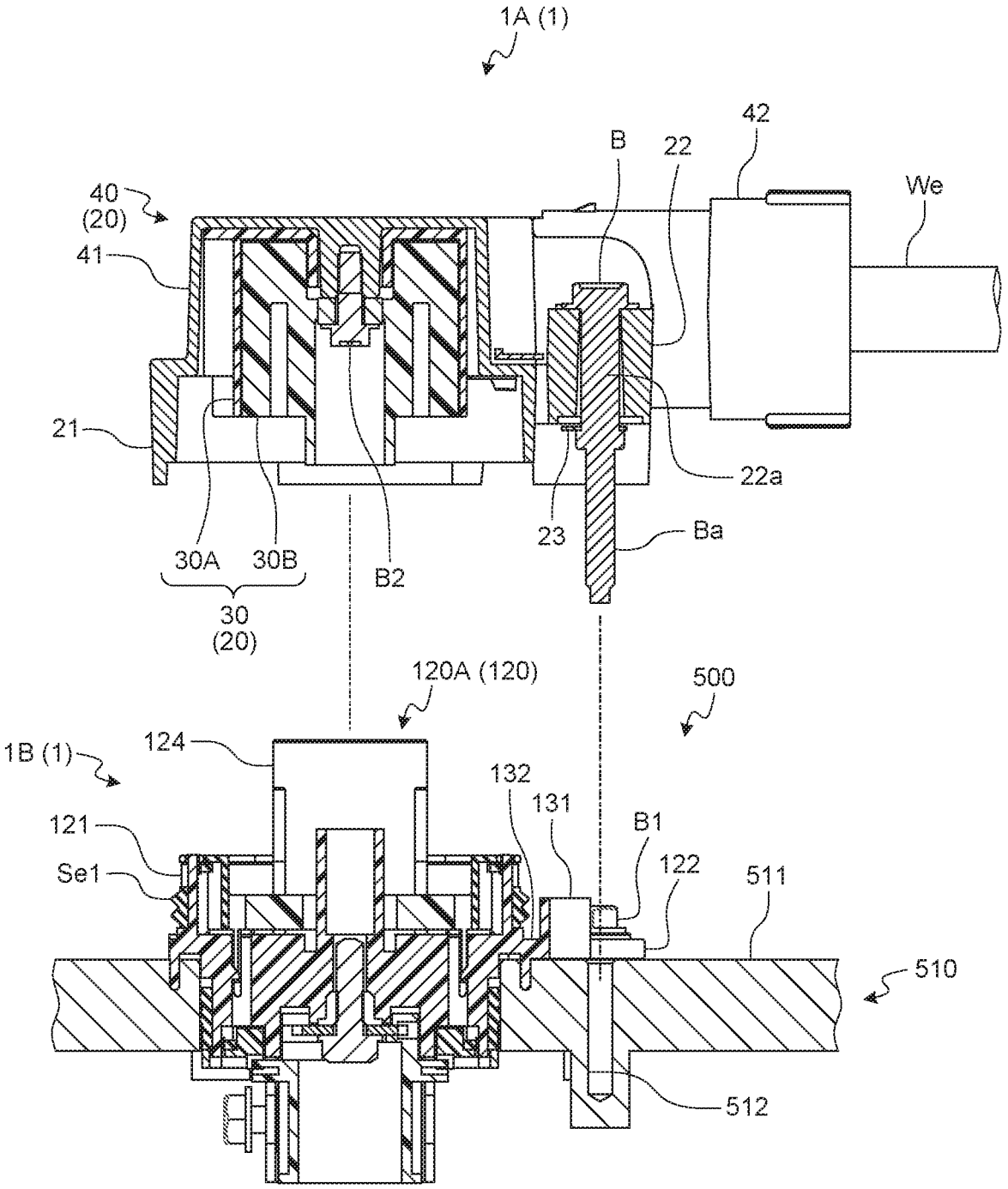
FIG. 4 is a cross-sectional view taken along line X-X in FIG. 3.
Figure 5:
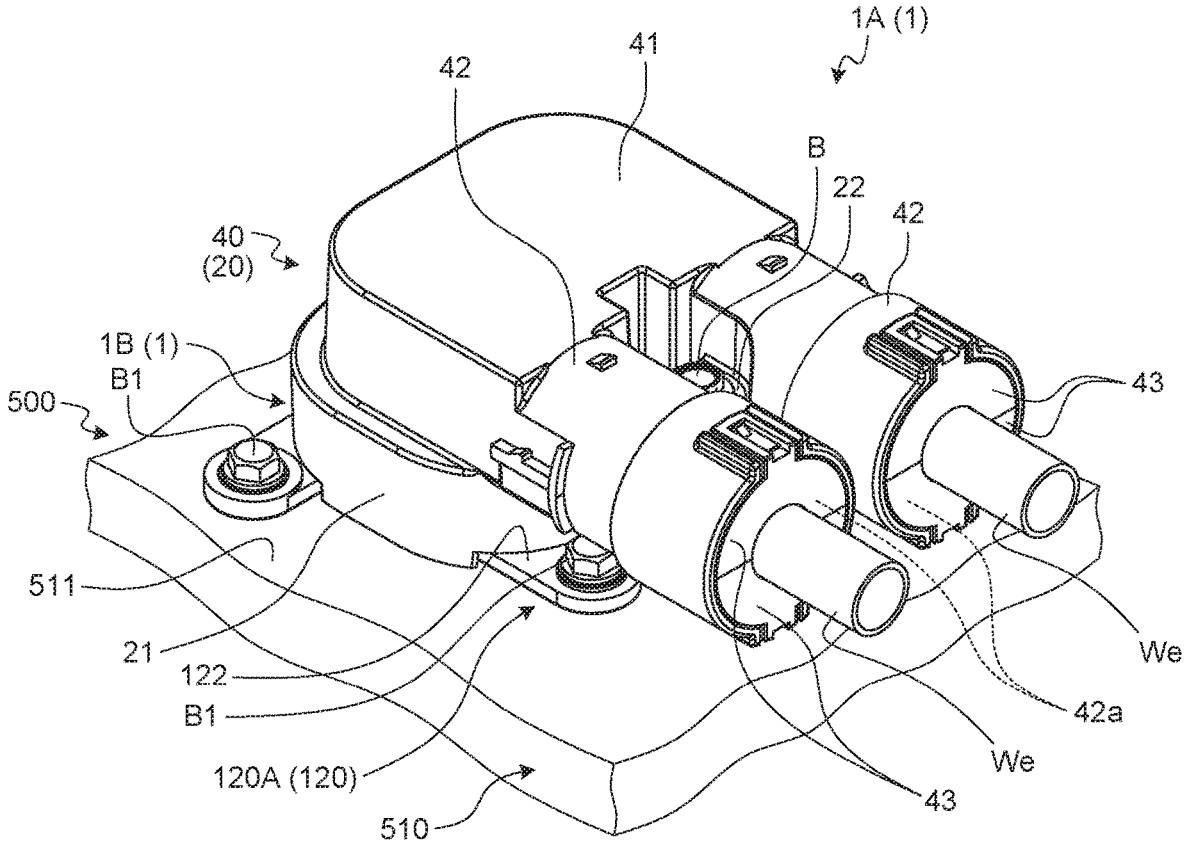
FIG. 5 is a perspective view illustrating the fitting connector of the embodiment after connector fitting.
Figure 6:
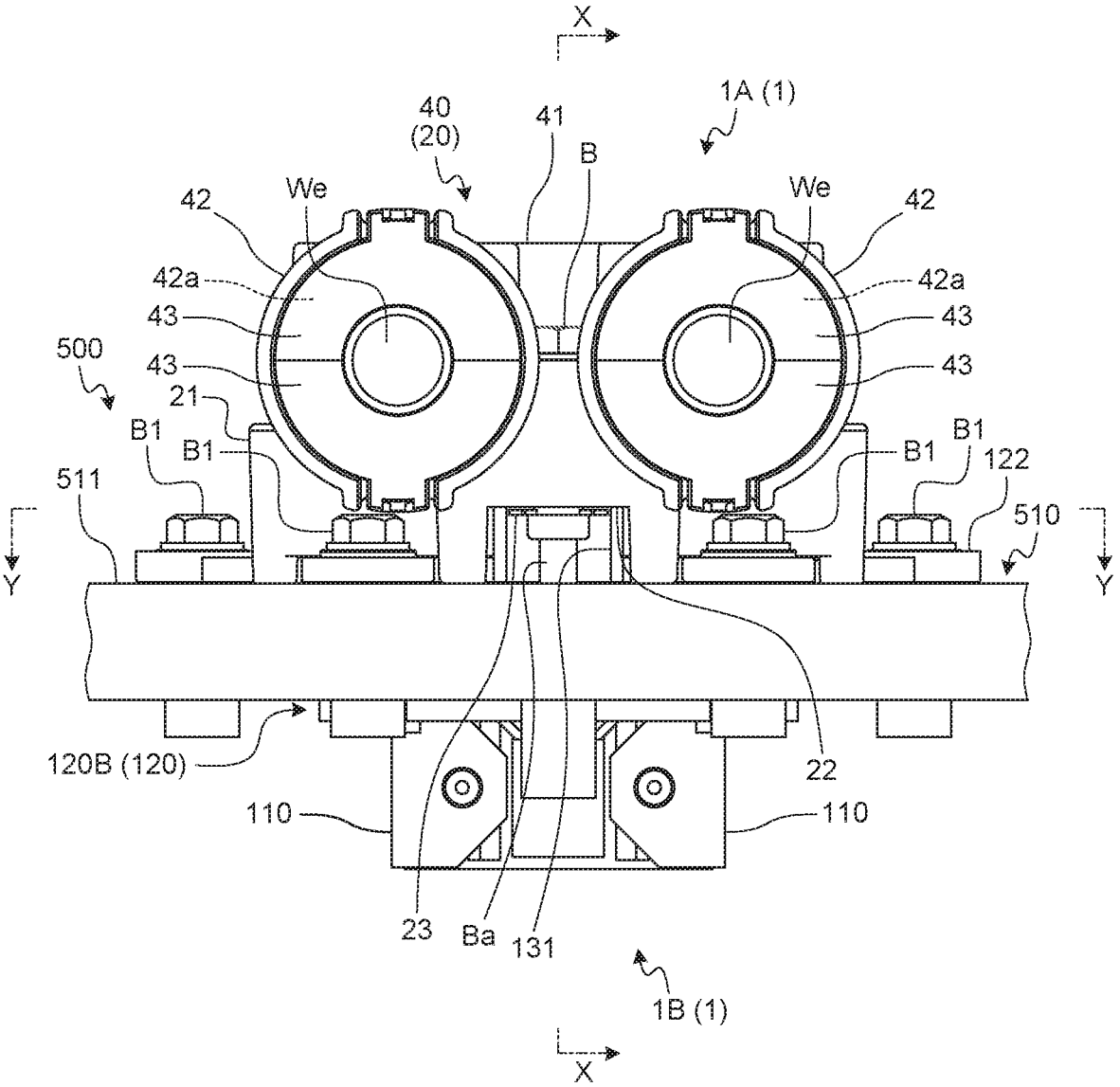
FIG. 6 is a plan view of the fitting connector of the embodiment after connector fitting when viewed at another angle.

The first storage member 30A and the second storage member 30B are fixed to the shield shell 40 by screwing using a male screw member B2 (FIGS. 4 and 9).

When at least the housing 30 is stored inside the shield shell 40, the shield shell 40 prevents noise from entering the electrical connection part 11 of the terminal clasp 10 stored inside the housing 30. The shield shell 40 in this example not only prevents noise from entering the inside of the housing 30 but also prevents noise from entering the electrical wire connection part 12 of the terminal clasp 10 and the terminal of the electrical wire We extending from the housing 30. For this, the shield shell 40 of this example stores a part from the housing 30 to the terminal of the electrical wire We. The shield shell 40 includes a primary shielding body 41 exposing the terminal insertion opening 33*b* and covering the housing 30 from the outside, and a secondary shielding body 42 covering, from the outside, the electrical wire connection part 12 and the terminal of the electrical wire We protruding out of the housing 30 through the insertion hole 32 (FIGS. 1 to 7 and 9).

The primary shielding body 41 has a tubular shape having one end opened in the tube axial direction. The primary shielding body 41 stores the housing 30 through the opening and exposes the terminal insertion opening 33*b* of the housing 30 through the opening.

The shield shell 40 includes the fitting part 21 described above. In the shield shell 40, the periphery of the opening of the primary shielding body 41 is used the fitting part 21 (FIGS. 1 to 7 and 9).

In the shield shell 40, a through-hole disposed opposite to the insertion hole 32 of the housing 30 is formed through the outer peripheral wall of the primary shielding body 41 for each insertion hole 32, and the secondary shielding body 42 that blocks the through-hole is formed for each through-hole.

The secondary shielding body 42 is formed in a cylindrical shape having both ends opened. The secondary shielding body 42 protrudes from the outer peripheral wall of the primary shielding body 41 so that the tube axial direction thereof is aligned with the direction orthogonal to the primary shielding body 41. In the shield shell 40, the inner space of the primary shielding body 41 and the inner space of the secondary shielding body 42 are communicated with each other through the through-hole of the primary shielding body 41 and one opening of the secondary shielding body 42.

In the secondary shielding body 42, the terminal of the electrical wire We extends outward through the other opening 42*a* (FIGS. 1 to 3, 5, 6, and 9).

The secondary shielding body 42 of this example is formed in a cylindrical shape, and an annular gap is formed between the inner peripheral surface thereof and the outer peripheral surface of the terminal of the electrical wire We. An annular waterproof member Se2 that is a sealing member such as a rubber plug and seals the annular gap is provided between the secondary shielding body 42 and the terminal of the electrical wire We (FIG. 9). The waterproof member Se2 is attached to the outer peripheral surface of the terminal of the electrical wire We coaxially with the terminal of the electrical wire We.

A holding member 43 through which the terminal of the electrical wire We extends outward and blocks the opening 42*a* is attached to an end part of the secondary shielding body 42 on the opening 42*a* side (FIGS. 1 to 3, 5, 6, and 9). The holding member 43 is made of a metallic material. The holding member 43 of this example has a two-block structure to prevent positional shift of the waterproof member Se2 and hold the electrical wire We at the center of the secondary shielding body 42.

In the first connector 1A, as described above, the electrical wire connection part 12 of the terminal clasp 10 protrudes through the insertion hole 32 of the insulating housing 30 and is covered by the conductive secondary shielding body 42. Thus, in the first connector 1A, an insulator is interposed between the conductive electrical wire connection part 12 and the secondary shielding body 42 to increase insulation distance (space distance and creepage distance) therebetween. The first connector 1A includes an insulating tubular member (hereinafter referred to as "insulation tube") 50 that covers the electrical wire connection part 12 and the terminal of the electrical wire We from the outside (FIG. 9). The insulation tube 50 is made of an insulating material such as synthesis resin. The insulation tube 50 is inserted into the inside of the secondary shielding body 42, and one end side thereof in the tube axial direction is inserted into the inside of the first storage member 30A through the insertion hole 32.

The following describes the second case 120 of the second connector 1B.

The second case 120 is made of an insulating material such as synthesis resin. The second case 120 includes the second fitting part 121 formed in a cylindrical shape described above, (FIGS. 1, 3, 4, 7, 8, and 10). The second case 120 is fixed to the outer wall (connector fixation wall 511) of the case 510 when the second fitting part 121 protrudes outward from the outer wall. For example, the second case 120 includes a plate flange part 122 on the periphery of the second fitting part 121. The flange part 122 is fixed to the connector fixation wall 511 by screwing using a male screw member B1 (FIGS. 1, 3 to 6, and 8).

Figure 1:
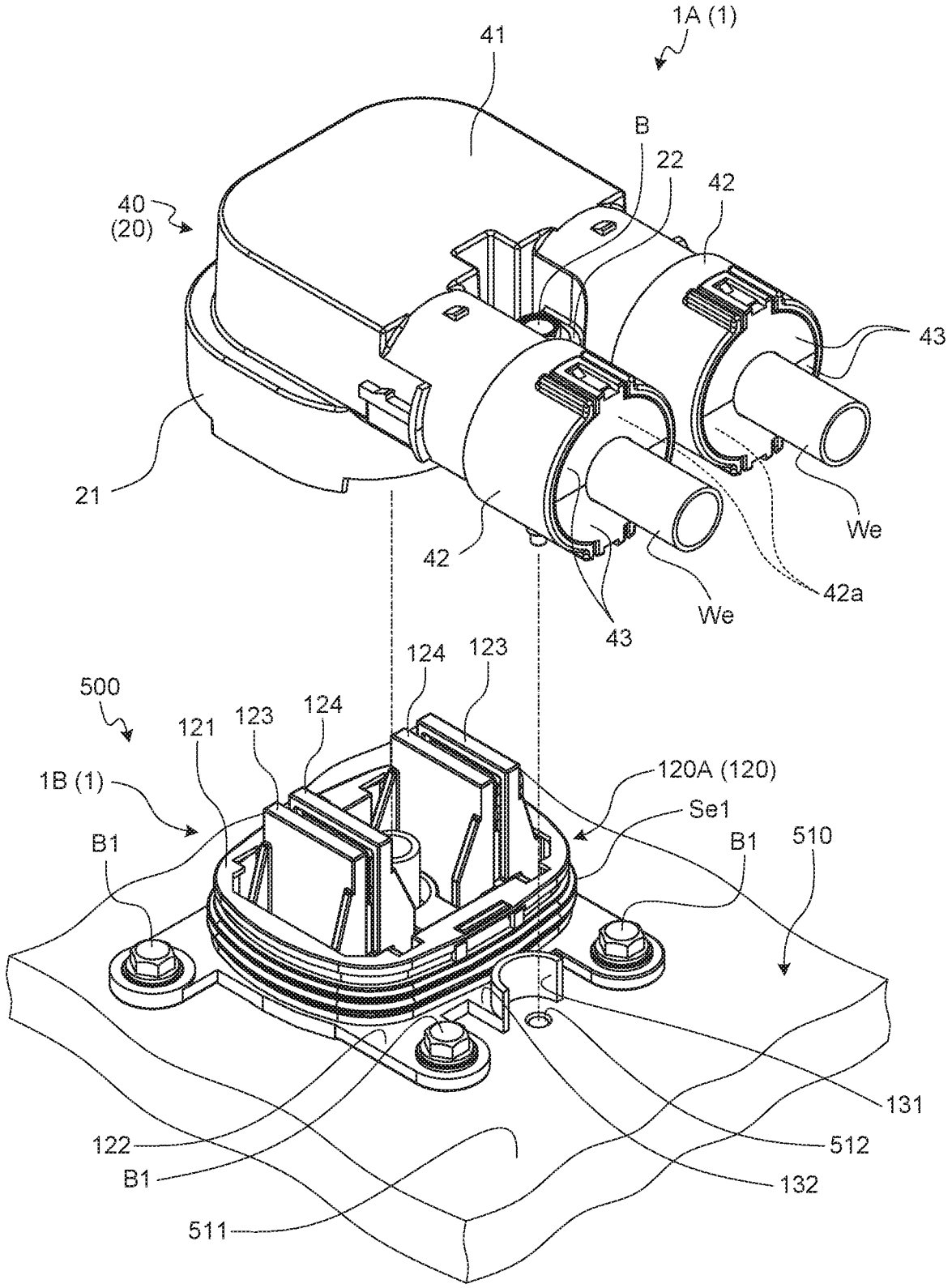
FIG. 1 is an exploded perspective view illustrating a fitting connector of an embodiment before connector fitting.
Figure 3:
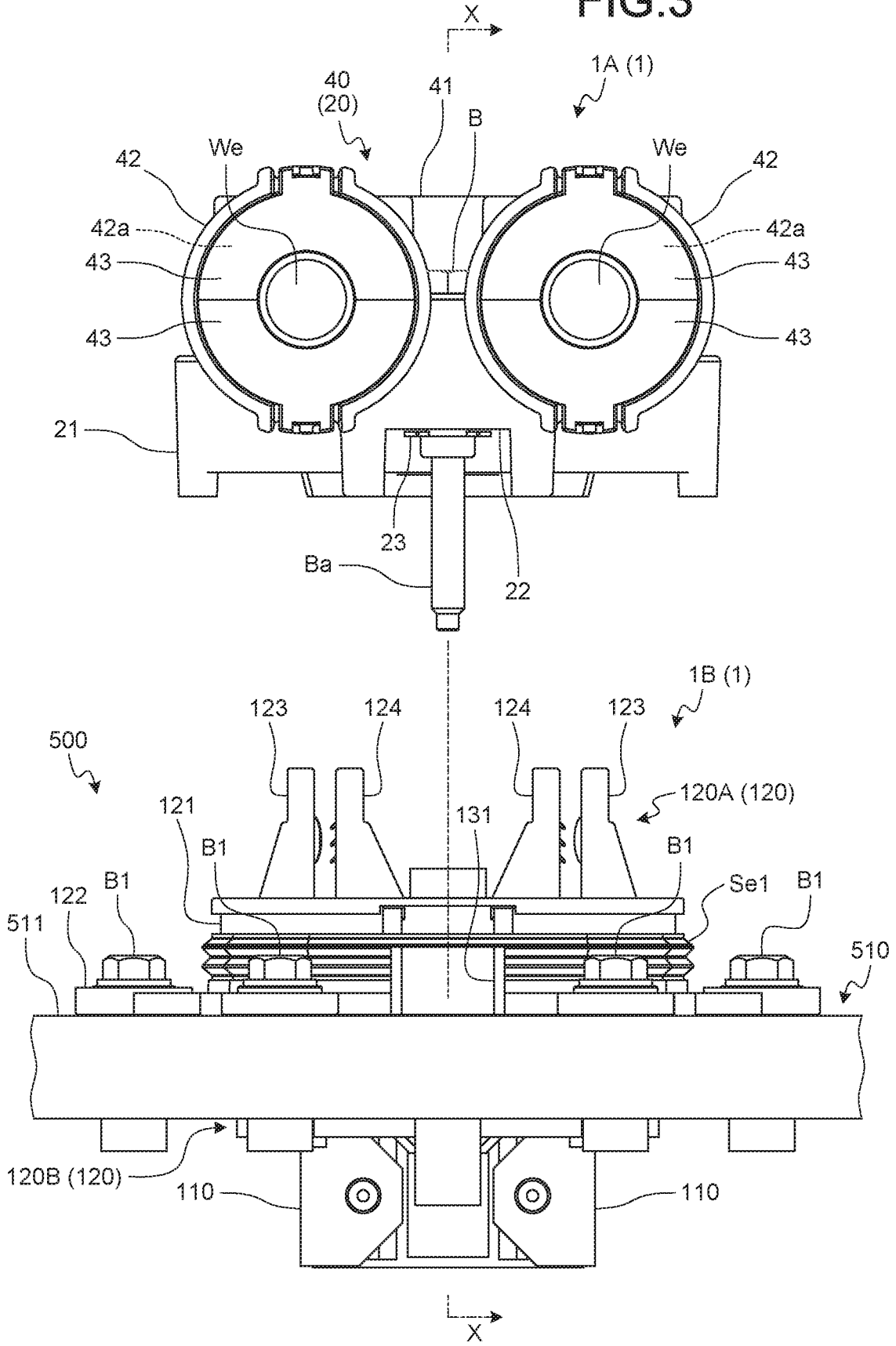
FIG. 3 is a plan view of the fitting connector of the embodiment before connector fitting when viewed at another angle.

The second case 120 includes a first contact point storage part 123 in which the first contact part 111*a* of the second terminal clasp 110 is stored, and a second contact point storage part 124 in which the second contact part 111*b* of the second terminal clasp 110 is stored (FIGS. 1, 3, and 10). The first contact point storage part 123 and the second contact point storage part 124 are disposed opposite to each other at an interval and expose parts of the first contact part 111*a* and the second contact part 111*b*, which contact the electrical connection part 11. The second case 120 of this example includes a storage member 120A and a holding member 120B (FIG. 10), and the holding member 120B holds the second terminal clasp 110 stored in the storage member 120A.

Figure 7:
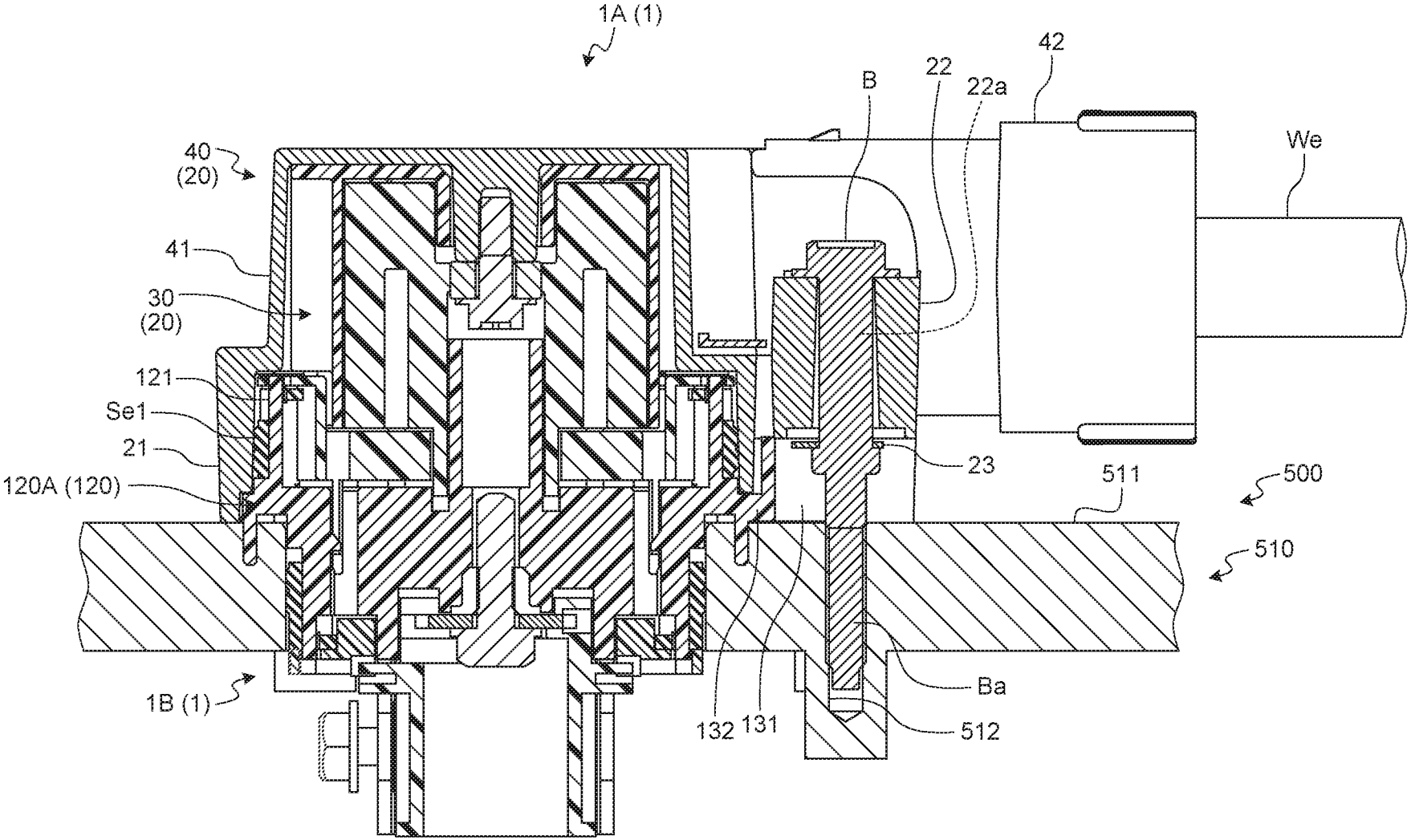
FIG. 7 is a cross-sectional view taken along line X-X in FIG. 6.

The fitting connector 1 of the present embodiment has a screw structure that generates, between the first connector 1A and the second connector 1B, connector fitting force for connector fitting of the first connector 1A and the second connector 1B and fixes the first connector 1A to the second connector 1B side after completion of the connector fitting. The screw structure is operated by screwing a first screw part Ba of the screw member B included in the first connector 1A and a second screw part 512 provided on the second connector 1B side (FIGS. 4 and 7). In the screw structure, the first case 20 is fixed to the connector fixation wall 511 outside of the outer peripheral surface of the second fitting part 121.

The screw member B is disposed opposite to the outer peripheral surface of the first fitting part 21 at an interval and held rotatably about a screw axis relative to the first case 20, the screw axis being aligned with a connector insertion-removal direction relative to the second connector 1B. For this, the first case 20 includes a screw holding part 22 that rotatably holds the screw member B (FIGS. 1 to 7 and 9). The second screw part 512 is provided to the connector fixation wall 511. The first screw part Ba of the screw member B and the second screw part 512 use axial force acting therebetween to generate connector fitting force in the tube axial direction between the first fitting part 21 and the second fitting part 121.

One of the first screw part Ba of the screw member B and the second screw part 512 is formed as a female screw part, and the other is formed as a male screw part. For example, when the screw member B is a female screw member such as a nut, a male screw part of a stud bolt as the second screw part 512 protrudes from the connector fixation wall 511. The screw member B of this example is a male screw member such as a bolt in which the first screw part Ba is formed as a male screw part. Thus, a female screw part as the second screw part 512 is formed in the connector fixation wall 511.

The screw member B is assembled to the shield shell 40. The screw member B of this example is disposed between the two secondary shielding bodies 42 while the screw axis is aligned with the direction in which the first fitting part 21 is connected by fitting to the second fitting part 121. Thus, the screw holding part 22 is provided between the two secondary shielding bodies 42 (FIGS. 1 to 7 and 9). The screw holding part 22 of this example is formed as a coupling body that couples the two secondary shielding bodies 42. The screw holding part 22 has a through-hole 22*a* in the direction in which the first fitting part 21 is connected by fitting to the second fitting part 121 (FIGS. 2, 4, and 7). The screw member B is inserted into the through-hole 22*a*. In the screw holding part 22, the head of the screw member B is locked to one end of the through-hole 22*a* in the hole axial direction, and the screw member B is locked through a lock member 23 to the other end of the through-hole 22*a* in the hole axial direction, thereby holding the screw member B while being inserted in the through-hole 22*a* (FIGS. 1 to 6, 7, and 9). In this example, the lock member 23 is a shaft snap ring.

In the fitting connector 1, for example, the length of the first screw part Ba of the screw member B is set so that screwing of the first screw part Ba of the screw member B and the second screw part 512 can be started when fitting of the first fitting part 21 and the second fitting part 121 is started. In this example, the relative positions of the first screw part Ba of the screw member B and the second screw part 512 are referred to as screw start positions. When the first screw part Ba of the screw member B and the second screw part 512 are at the screw start positions, the first fitting part 21 does not entirely cover the outer peripheral surface side of the waterproof member Se1, and accordingly, at least part of the waterproof member Se1 is exposed. In the fitting connector 1, screwing of the first screw part Ba of the screw member B and the second screw part 512 is completed when the first fitting part 21 and the second fitting part 121 are at fitting completed positions. In this example, the relative positions of the first screw part Ba of the screw member B and the second screw part 512 when the screwing is completed are referred to as screwing completed positions.

In the fitting connector 1 of the present embodiment, a dustproof wall 131 that prevents shavings from reaching the second fitting part 121 side is provided on the second connector 1B side, the shavings being generated in an operation to tighten or loosen the first screw part. Ba of the screw member B and the second screw part 512 (FIGS. 1, 3, 4, 6 to 8, and 10). For example, the screw member B and the case 510 are each made of a metallic material. Thus, metallic shavings are potentially generated between the first screw part Ba of the screw member B and the second screw part 512 when the first screw part Ba of the screw member B and the second screw part 512 are fastened or loosened. The dustproof wall 131 prevents the metallic shavings from reaching the second fitting part 121 side, thereby preventing the shavings from adhering to the waterproof member Se1. For this, the dustproof wall 131 is erected in the tube axial direction (connector insertion-removal direction) from the connector fixation wall 511 side between the outer peripheral surface side of the second fitting part 121 and the second screw part 512 side. In other words, the dustproof wall 131, at the connector fitting position, is present between part of the first screw part Ba protruding from the connector fixation wall 511 and the outer peripheral surface of the first fitting part 21, and is disposed opposite to the part of the first screw part Ba and the outer peripheral surface of the first fitting part 21.

The dustproof wall 131 not only prevents shavings from adhering to the waterproof member Se1 but also functions as a protection wall that prevents the screw member B from contacting the second fitting part 121 and the waterproof member Se1 at assembly of the first connector 1A and the second connector 1B.

The dustproof wall 131 is formed in a partially cylindrical shape having an inner peripheral surface arcing around the second screw part 512 side. In this example, the dustproof wall 131 has a semi-cylindrical shape having a tube axial direction aligned with the connector insertion-removal direction.

The dustproof wall 131 is provided to one of the second case 120 and the connector fixation wall 511. When provided to the connector fixation wall 511, the dustproof wall 131 is erected from the connector fixation wall 511.

In this example, the dustproof wall 131 is provided to the second case 120. When provided with the dustproof wall 131, the second case 120 includes a coupling part 132 that is elastically deformable in the tube axial direction (connector insertion-removal direction) and through which the dustproof wall 131 is coupled with the second fitting part 121 side (FIGS. 1, 4, 7, 8, and 10). The dustproof wall 131 of this example is coupled with the second fitting part 121 through the flexible coupling part 132.

The dustproof all 131 and the coupling part 132 of this example have a gap to the connector fixation wall 511 in the tube axial direction (connector insertion-removal direction). Thus, the dustproof wall 131 can release, through deformation of the coupling part 132, force received by the screw member B upon contact with the screw member B at assembly of the first connector 1A and the second connector 1B.

The screw holding part 22 of this example desirably contacts the dustproof wall 131 in the tube axial direction (connector insertion-removal direction) at the connector fitting position. Thus, the size of the gap between the connector fixation wall 511 and each of the dustproof wall 131 and the coupling part 132 is desirably set to be such a size that positional shift of the screw holding part 22, the dustproof wall 131, and the like due to tolerance variance can be absorbed through deformation of the coupling part 132. At the connector fitting position, the screw holding part 22 contacts the dustproof wall 131 in the tube axial direction so that no gap is generated between the screw holding part 22 and the dustproof wall 131 in the tube axial direction. Thus, in this case, it is possible to prevent a situation in which shavings move over the dustproof wall 131 and reach the second fitting part 121 side.

When the gap between the connector fixation wall 511 and each of the dustproof wall 131 and the coupling part 132 potentially prompts shavings to reach the second fitting part 121 side, the dustproof wall 131 is desirably formed to provide no gap to the connector fixation wall 511 in the tube axial direction (connector insertion-removal direction).

In the fitting connector 1 of the present embodiment above described, shavings generated between the first screw part Ba of the screw member B and the second screw part 512 in a tightening operation at assembly of the first connector 1A and the second connector 1B can be prevented from moving toward the second fitting part 121 side by the dustproof wall 131 on the second connector 1B side. In addition, in the fitting connector 1, shavings around the first screw part Ba of the screw member B and the second screw part 512 when the first connector 1A and the second connector 1B in a connector fitting state can be prevented from moving toward the second fitting part 121 side by the dustproof wall 131 on the second connector 1B side. In addition, in the fitting connector 1, shavings generated between the first screw part Ba of the screw member B and the second screw part 512 in a loosening operation while the first connector 1A is removed from the second connector 1B can be prevented from moving toward the second fitting part 121 side by the dustproof wall 131 on the second connector 1B side. In the second connector 1B after the removal, shavings around the second screw part 512 can be prevented from moving toward the second fitting part 121 side by the dustproof wall 131. In this manner, in the fitting connector 1 of the present embodiment, the dustproof wall 131 can prevent shavings generated between the first screw part Ba of the screw member B and the second screw part 512 from moving toward the second fitting part 121 side and entering between the first fitting part 21 and the second fitting part 121, thereby preventing the shavings from adhering to the waterproof member Se1. Accordingly, in the fitting connector 1, shavings are prevented from being dragged between the first fitting part 21 and the waterproof member Se1 at insertion and removal of the first connector 1A and the second connector 1B, and shavings are prevented from remaining between the first fitting part 21 and the waterproof member Se1 after connector fitting completion. Thus, the fitting connector 1 can have improved liquid tightness between the first fitting part 21 and the second fitting part 121 by the waterproof member Se1.

In addition, in the fitting connector 1 of the present embodiment, the dustproof wall 131 on the second connector 1B side can prevent the screw member B from contacting the second fitting part 121 and the waterproof member Se1 at assembly of the first connector 1A to the second connector 1B, thereby preventing degradation of durability of the second fitting part 121 and the waterproof member Se1. Thus, with this configuration as well, the fitting connector can have improved liquid tightness between the first fitting part 21 and the second fitting part 121 by the waterproof member Se1.

In addition, in the fitting connector 1 of the present embodiment, the screw holding part 22 contacts the dustproof wall 131 in the tube axial direction (connector insertion-removal direction) at the connector fitting position, and thus shavings can be prevented from moving over the dustproof wall 131 upon application of vibration and the like, for example, while a vehicle is traveling. Thus, with this configuration as well, the fitting connector 1 can prevent shavings from reaching the second fitting part 121 side and entering between the first fitting part 21 and the second fitting part 121, and thus can have improved liquid tightness between the first fitting part 21 and the second fitting part 121 by the waterproof member Se1.

In a fitting connector according to the present embodiment, when the first and second connectors are inserted, removed, or in a connector fitting state, shavings generated between the first and second screw parts of the screw member can be prevented from moving to the second fitting part side by the dustproof wall on the second connector side. Accordingly, the fitting connector can prevent the shavings from entering between the first and second fitting parts.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fitting connector comprising:

a first connector and a second connector electrically connected with each other at a connector fitting position at which the connectors are fitted to each other, wherein the first connector includes a first terminal clasp, a first case in which the first terminal clasp is stored and that includes a first fitting part having a tubular shape, and a screw member including a first screw part, disposed opposite to an outer peripheral surface of the first fitting part at an interval, and held rotatably about a screw axis relative to the first case, the screw axis being aligned with a direction in which the connectors are inserted and removed relative to the second connector, the second connector includes a second terminal clasp electrically connected with the first terminal clasp, a second case in which the second terminal clasp is stored and that includes a second fitting part having a tubular shape and connected by fitting to the first fitting part in a tube axial direction, and a second screw part provided in a connector fixation wall to which the second case is fixed and to which the first case is fixed outside of an outer peripheral surface of the second fitting part, the second screw part being configured to generate connector fitting force in the tube axial direction between the first fitting part and the second fitting part by using axial force acting between the first screw part of the screw member as a screw target and the second screw part, and one of the second case and the connector fixation wall includes a dustproof wall erected in the tube axial direction from the connector fixation wall side between the outer peripheral surface side of the second fitting part and the second screw part side.

2. The fitting connector according to claim 1, wherein the dustproof wall is formed in a partially cylindrical shape having an inner peripheral surface arcing around the second screw part side.

3. The fitting connector according to claim 1, wherein when the second case is provided with the dustproof wall, the second case includes a coupling part that is elastically deformable in the tube axial direction and through which the dustproof wall is coupled with the second fitting part side, and the dustproof wall and the coupling part have a gap to the connector fixation wall is the tube axial direction.

4. The fitting connector according to claim 2, wherein when the second case is provided with the dustproof wall, the second case includes a coupling part that is elastically deformable in the tube axial direction and through which the dustproof wall is coupled with the second fitting part side, and the dustproof wall and the coupling part have a gap to the connector fixation wall in the tube axial direction.

5. The fitting connector according to claim 3, wherein the first case includes a screw holding part that rotatably holds the screw member, and the screw holding part contacts the dustproof wall in the tube axial direction at the connector fitting position.

6. The fitting connector according to claim 4, wherein the first case includes a screw holding part that rotatably holds the screw member, and the screw holding part contacts the dustproof wall in the tube axial direction at the connector fitting position.

7. The fitting connector according to claim 1, wherein the screw member is a male screw member in which the first screw part is formed as a male screw part, and the second screw part is a female screw part formed in the connector fixation wall.

8. The fitting, connector according to claim 2, wherein the screw member is a male screw member in which the first screw part is formed as a male screw part, and the second screw part is a female screw part formed in the connector fixation wall.

9. The fitting connector according to claim 3, wherein the screw member is a male screw member in which the first, screw part is formed as a male screw part, and the second screw part is a female screw part formed in the connector fixation wall.

10. The fitting connector according to claim 4, wherein the screw member is a male screw member in which the first screw part is formed as a male screw part, and the second screw part is a female screw part formed in the connector fixation wall.

11. The fitting connector according to claim 5, wherein the screw member is a male screw member in which the first screw part is formed as a male screw part, and the second screw part is a female screw part formed in the connector fixation wall.

12. The fitting connector according to claim 6, wherein the screw member is a male screw member in which the first screw part is formed as a male screw part, and the second screw part is a female screw part formed in the connector fixation wall.

13. The fitting connector according to claim 1, wherein the dustproof wall is formed to prevent shavings from reaching the second fitting part side, the shavings being generated in an operation to tighten or loosen the first screw part and the second screw part.

14. The fitting connector according to claim 2, wherein the dustproof wall is formed to prevent shavings from reaching the second fitting part side, the shavings being generated in an operation to tighten or loosen the first screw part and the second screw part.

15. The fitting connector according to claim 3, wherein the dustproof wall is formed to prevent shavings from reaching the second fitting part side, the shavings being generated in an operation to tighten or loosen the first screw part and the second screw part.

16. The fitting connector according to claim 4, wherein the dustproof wall is formed to prevent shavings from reaching the second fitting part side, the shavings being generated in an operation to tighten or loosen the first screw part and the second screw part.

17. The fitting connector according to claim 5, wherein the dustproof wall is formed to prevent shavings from reaching the second fitting part side, the shavings being generated in an operation to tighten or loosen the first screw part and the second screw part.

18. The fitting connector according to claim 6, wherein the dustproof wall is formed to prevent shavings from reaching the second fitting part side, the shavings being generated in an operation to tighten or loosen the first screw part and the second screw part.

19. The fitting connector according to claim 7, wherein the dustproof wall is formed to prevent shavings from reaching the second fitting part side, the shavings being generated in an operation to tighten or loosen the first screw part and the second screw part.

* * * * *